US006076281A

United States Patent [19]

Kilpiä et al.

[11] Patent Number: 6,076,281

[45] Date of Patent: Jun. 20, 2000

[54] WEB FINISHING SECTION IN A PAPER MACHINE

[75] Inventors: Jukka Kilpiä , Muurame; Jyrki Rantanen, Jyväskylä; Sirkka Lehtonen, Jyskä, all of Finland

[73] Assignee: Valmet Corporation, Helsinki, Finland

[21] Appl. No.: 09/326,888

[22] Filed: Jun. 7, 1999

Related U.S. Application Data

[63] Continuation-in-part of application No. 09/033,771, Mar. 3, 1998, Pat. No. 5,943,787.

[60] Provisional application No. 60/042,106, Mar. 26, 1997.

[30] Foreign Application Priority Data

Mar. 3, 1997 [FI] Finland ..... 970904

[51] Int. Cl.[7] ..... F26B 3/00

[52] U.S. Cl. ..... 34/457; 34/462; 34/466; 34/117; 34/120; 34/625

[58] Field of Search ..... 34/443, 447, 457, 34/462, 111, 116, 117, 120, 623, 625; 162/358.1, 358.3, 360.3; 242/256.3, 532.2, 533.2, 541.1, 541.3

[56] References Cited

U.S. PATENT DOCUMENTS

| | | | |
|---|---|---|---|
| 1,975,132 | 10/1934 | Van Derhoef | 34/462 X |
| 2,770,015 | 11/1956 | Rosser et al. | 34/466 X |
| 3,089,252 | 5/1963 | Daane et al. | 34/457 X |
| 4,179,330 | 12/1979 | Page | 162/113 |
| 5,251,835 | 10/1993 | Kyytsonen | 242/65 |
| 5,483,873 | 1/1996 | Koivukunnas et al. | 100/38 |
| 5,493,790 | 2/1996 | Brossard | 34/117 |
| 5,531,396 | 7/1996 | Kinnunen et al. | 242/526.3 |
| 5,765,294 | 10/1934 | Puschnerat | 34/464 X |

FOREIGN PATENT DOCUMENTS

| | | | |
|---|---|---|---|
| 0648893 | 4/1995 | European Pat. Off. | D21G 1/00 |
| 8702722 | 5/1987 | WIPO | D21F 11/00 |

*Primary Examiner*—Stephen Gravini
*Attorney, Agent, or Firm*—Steinberg, Raskin & Liberchuk, P.C.

[57] ABSTRACT

A web finishing section in a paper machine including a dryer section having one or more dryer groups, a calender and a reel-up. The calender is placed at least partly underneath the reel spool storage space of the reel-up so that the reel-up is placed substantially directly after the calender, in which case, the web is passed directly from a calendering nip in the calender onto the reel cylinder or to a substantially short distance from the calender, the web being passed over one guide member that supports and/or spreads the web onto the reel cylinder. The calender includes one or more calendering belts for carrying the web through the calendering nip(s). A method for finishing a web is also described.

23 Claims, 3 Drawing Sheets

35A
30A
32A
31A
34A
33A
37A
42A
27A
25A
20A
NA 2
NA 1
26A
28A
41A
10A
14A
RAN
12A
15A
11A
16A
13A
17A
L1
35
32
31
34
29
37
30
33
45
N2
41
20
N1
28
45
10
12
14
15
11
RN
13
17
16

WEB FINISHING SECTION IN A PAPER MACHINE

CROSS REFERENCE TO RELATED APPLICATIONS

This application is a continuation-in-part of U.S. patent application Ser. No. 09/033,771 filed Mar. 3, 1998 U.S. Pat. No. 5,943,787 which claims priority under 35 U.S.C. §119 (e) of U.S. provisional patent application Ser. No. 60/042,106 filed Mar. 26, 1997.

FIELD OF THE INVENTION

The present invention relates to a web finishing section in a paper machine, which finishing section comprises a dryer section comprising one or more dryer groups, a calender arranged after the dryer section and a reel-up arranged after the calender.

The present invention relates to a method for finishing a web in a finishing section of a paper machine, in which the web is dried in a dryer section comprising one or more dryer groups, calendered in a calender arranged after the dryer section and reeled onto a reel spool in a reel-up arranged after the calender.

BACKGROUND OF THE INVENTION

In the prior art embodiments of finishing sections in paper machines, both before the calender and in particular from the calender to the reel-up, the web has long, substantially free or unsupported draws, which increases the length of the finishing section in the paper machine to a substantial extent and requires threading ropes for the threading of the leader of the web. Further, at these draws, various quality measurement devices are arranged for measuring and monitoring the quality of the paper web. Costs have, of course, also arisen from the paper guide rolls required by the draws. Thus, the long draws of the paper web have also required threading ropes and related arrangements of equipment and equivalent, by whose means the leader of the paper web is carried during threading from one stage into the other, which has increased the costs of equipment further.

OBJECTS AND SUMMARY OF THE INVENTION

It is an object of the present invention to provide a finishing section for a paper machine in which the problems described above have been eliminated or at least minimized.

It is a further object of the present invention to provide a finishing section for a paper machine in which the length of the finishing section can be made shorter compared with the finishing sections currently in use.

It is another object of the present invention to provide new and improved methods for finishing a web in a finishing section of a paper machine in which the path of travel of the web is less than in prior art finishing sections.

It is still another object of the present invention to provide a finishing section including a belt calender and/or a belt reel-up.

In view of achieving the objects stated above and those that will come out later, the finishing section in a paper machine in accordance with the present invention comprises a calender placed at least partly underneath the reel spool storage space of the reel-up so that the reel-up is placed substantially directly after the calender. In this manner, the web is passed directly from the calendering nip onto the reel cylinder or to a substantially short distance from the calender, the web being passed over one guide member that supports and/or spreads the web onto the reel cylinder.

The arrangement in accordance with the present invention permits a ropeless threading, because there are no long unsupported draws, in which case, for threading, it is possible to use, for example, guide plates and/or equivalent suitable for full-width transfer of the web. For example, in an application in which the calender is a belt calender and the reel-up is a belt reel-up, ropeless threading can be arranged particularly simply so that the web is passed from the last drying cylinder in the dryer section by means of guide plates or equivalent directly onto the belt in the belt calender, on whose belt the web is passed through the calendering nips and further onto the belt in the belt reel-up. One belt calender is described in the current assignee's Finnish Patent Application No. 931021 (corresponding to the current assignee's U.S. Pat. No. 5,483,873, incorporated by reference herein), and one application of a belt reel-up is described in the current assignee's Finnish Patent Application No. 935669 (corresponding to the current assignee's U.S. Pat. No. 5,531,396, incorporated by reference herein).

In this regard, one embodiment of a web finishing section in a paper machine comprises a dryer section having at least one dryer group for drying the web, a reel-up arranged after the dryer section for reeling the web and including means defining a reel spool storage space in which empty reel spools are stored and a reel cylinder over which the web is passed to be reeled onto a reel spool, and a calender arranged after the dryer section and at least partly underneath the reel spool storage space. The calender includes at least a first calendering nip defined by two rolls and at least a first calendering belt for carrying the web through the first calendering nip such that the web is calendered in the first calendering nip. The calender may be arranged such that the first calendering belt receives the web directly from a belt in the dryer section and/or that the web is passed into the reel-up directly from the first calendering belt.

The calender may also include a second calendering nip defined by two rolls and a second calendering belt for carrying the web through the second calendering nip, the web being transferred between the first and second calendering belts at a location between the first and second calendering nips. Guide rolls are then arranged in a loop of each calendering belt, one guide rolls in the loop of each belt being arranged opposite one another such that the web is transferred between the calendering belts about the opposite guide rolls. At least one of the opposite guide rolls is adjustable to facilitate detachment of the web from the belt of the dryer section. One the calendering nips is arranged entirely underneath the reel storage space.

In some embodiments, the finishing section includes a blow plate arranged in a space between the dryer section and the calender, the web being transferred from the dryer section to the first calendering belt through the space. A belt transfer device may also be provided for transferring the web from the first calendering belt to the reel-up.

The arrangement in accordance with the present invention is partly made possible by the fact that, at present, various quality meters are in themselves known whose size is considerably smaller than the size of meters that were in use earlier, in which case such meters can be arranged in a simple way in connection with a calender, in particular with a soft calender, and/or with a reel-up without a separate support construction provided for such meters.

By means of an arrangement in accordance with the invention, considerable economies of length are obtained in the finishing section, which economies of length correspond, for example, to a distance in which a group consisting of six drying cylinders can be accommodated, in which case, the capacity of the dryer section can be increased without changing the overall length of the machine. On the other hand, with the same overall length, the production rate can be increased, for example, from about 615 tons to about 735 tons per day, or the speed from about 1500 meters per minute to about 1800 meters per minute, which corresponds to an increase in production of about 16 per cent. Of course, owing to the present invention, it is also possible to construct a machine of shorter length, compared with the prior art, with unchanged capacity, in which case, economies can be obtained, for example, in the costs of construction of the paper machine hall, which costs in themselves constitute a major cost item, since the cost per meter of a paper machine hall is about one million Finnish marks.

By means of an arrangement in accordance with the invention, modernizations of existing paper machines in view of increasing their capacity are also made possible, which modernizations could not be carried out earlier because of lack of space.

In the arrangement in accordance with the invention, the short web draws after the calender permit a full-width threading of the web based on what is called the "coanda effect", because the exclusively airborne support and guiding of the web, which is difficult to control over unduly long distances, can be reduced to a minimum.

In the arrangement in accordance with the invention, economies are also obtained in the paper guide rolls (2 rolls), and just one pulper is needed, because a common pulper can be used for the dryer section and for the reel-up as the distance between them becomes shorter.

If cooling of the web is needed between the calender and the reel-up, it is possible to use various cooling devices in themselves known, such as a blow box.

The advantages of the present invention are manifested particularly well in a combination of a soft calender and a reel-up marketed by the assignee under the trademark Optireel™, which reel-up is described in more detail, e.g., in the current assignee's Finnish Patent Application No. 905284 (corresponding to U.S. Pat. No. 5,251,835, incorporated by reference herein).

A method for finishing a web in a finishing section in a paper machine in accordance with the invention comprises the steps of drying the web by passing the web through a dryer section having at least one dryer group, then calendering the dried web after the dryer section in a calender including a first calendering belt by transferring the web to a first calendering belt and carrying the web on the first calendering belt through at least a first calendering nip defined by two rolls, then reeling the calendered web in a reel-up by passing the web over a reel cylinder onto a reel spool, and storing empty reel spools for use in the reel-up in a reel spool storage space defined at least partially above the calender. The web may be passed directly from a belt in the dryer section to the first calendering belt and/or directly from the first calendering belt to the reel-up. The web may be supported in a run between the calendering nip and the reel cylinder by means of a single guide roll. The calender may be arranged substantially directly after a last one of the at least one dryer group in the dryer section in a running direction of the web, the last dryer group possibly being a twin-wire draw dryer group or a single-wire draw dryer group.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE INVENTION

Figures 1A, 1B:
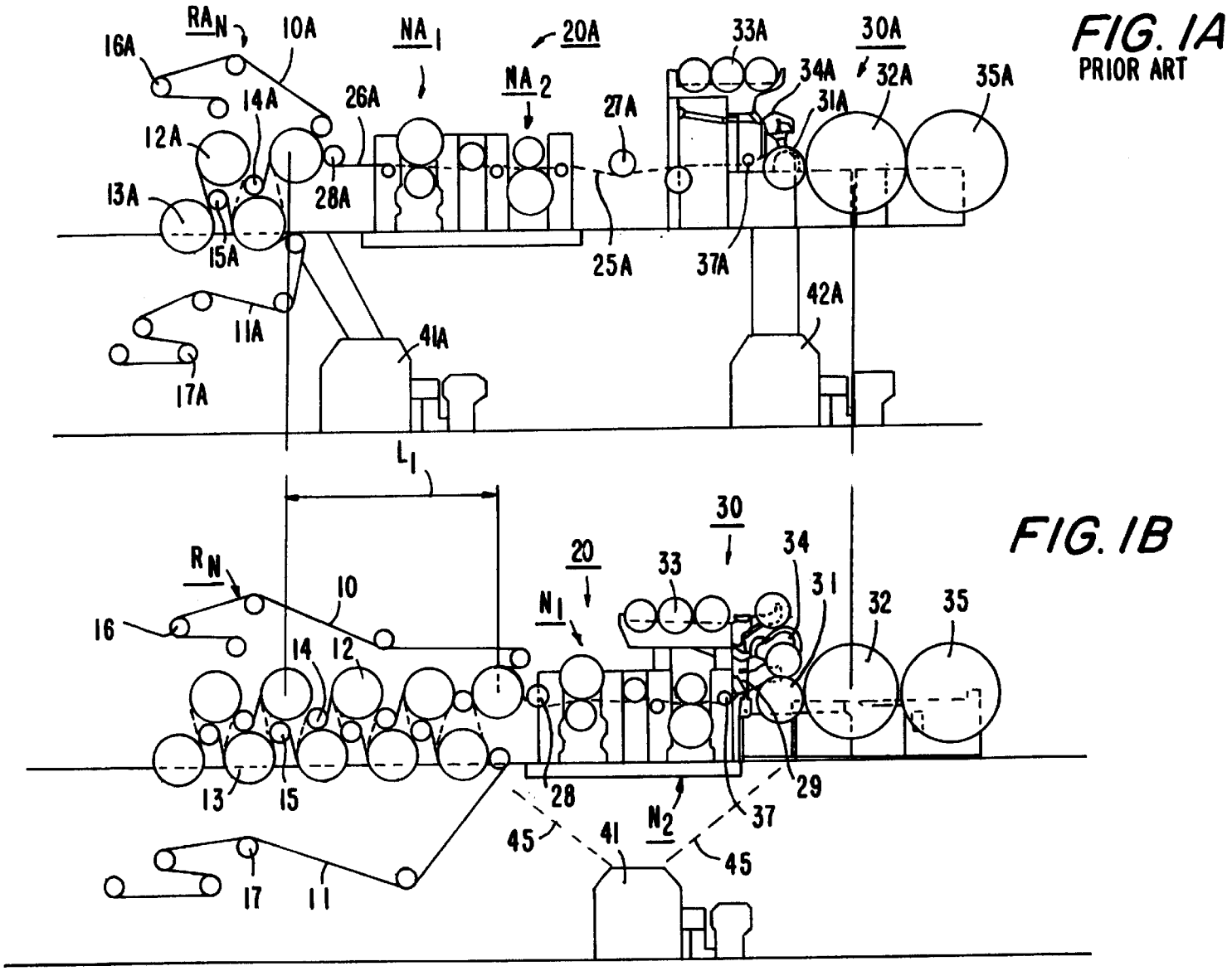
FIG. 1A PRIOR ART
FIG. 1A is a schematic illustration of a prior art paper machine arrangement, in which the last group in the dryer section is a dryer group with twin-wire draw.
FIG. 1B is a schematic illustration of a finishing section in an arrangement in accordance with the present invention in which, as in FIG. 1A, the last group in the dryer section is a dryer group with twin-wire draw.

In the drawings, corresponding reference numerals refer to corresponding parts, and the letter symbol A added after a reference numeral refers to the prior art arrangements.

In the prior art arrangement shown in FIG. 1A, the last dryer group $RA_N$ in the dryer section in the finishing section makes use of twin-wire draw, after which group the web is passed as a draw 26A to a soft calender 20A, which is followed by a second draw of the web 25A, supported by paper guide rolls 27A, to a reel-up 30A. Pulpers 41A and 42A of the dryer section and the reel-up 30A, respectively, are placed below the machine level in the so-called basement space.

In the twin-wire draw in the dryer group $RA_N$, endless wires 10A, 11A run while being guided by guide means, such as guide rolls 16A, 17A, over drying cylinders 12A, 13A and reversing rolls 14A, 15A in the manner of twin-wire draw. The web has free draws between the rows of drying cylinders 12A, 13A, as in a standard twin-wire draw dryer group. From the dryer group $RA_N$, the paper web is passed over a guide roll 28A as the draw 26A into a first calendering nip $NA_1$ in the calender 20A. The web is passed from the first calendering nip $NA_1$ into a second calendering nip $NA_2$, and from there as the draw 25A over the guide rolls 27A to the reel-up 30A. The storage space for reel spools in the reel-up 30A is denoted by reference numeral 33A, the reel spool change devices are denoted by reference numeral 34A, the reel cylinder is denoted by reference numeral 31A, the paper reel that is being formed is denoted by reference numeral 32A, and the complete machine reel is denoted by reference numeral 35A.

As shown in FIG. 1B, the length of the finishing section in the paper machine in accordance with the invention is shorter so that the draws 26A,25A between the last dryer group $R_N$ and the soft calender 20 and between the soft calender 20 and the reel-up 30 have become substantially shorter. Specifically, to accomplish this, the reel spool storage space 33 of the reel-up 30 is placed above the soft calender 20 entirely above the calendering nip $N_1$, and the pulpers of the dryer section and of the reel-up are combined into a single pulper 41. In the dryer group $R_N$, the drying wires are denoted by reference numerals 10,11, and they run, guided by guide means such as guide rolls 16,17, over drying cylinders 12,13 and reversing rolls 14,15. Between the rows of drying cylinders 12,13, the web has free draws. From the last drying cylinder, the web is passed as a short draw over a roll 28 into a first calendering nip $N_1$ in the calender 20, from which it is passed into a second calendering nip $N_2$. The web is passed over a single roll 37 past a quality meter 29 and then passed over a reel cylinder 31 to be reeled as a paper reel 32. The reel spool storage space in the reel-up 30 is denoted by reference numeral 33, the reel spool change device is denoted by reference numeral 34, and the complete machine reel is denoted by reference numeral 35.

As exemplified by the comparison of FIGS. 1A and 1B, economies of length arc achieved in the arrangement in accordance with the invention, i.e., it is shorter. By way of example, it can be stated that in an embodiment of the invention, the economies of length $L_1$ in a transition from an arrangement as shown in FIG. 1A into an arrangement as shown in FIG. 1B are about 7650 mm.

Figure 2A:
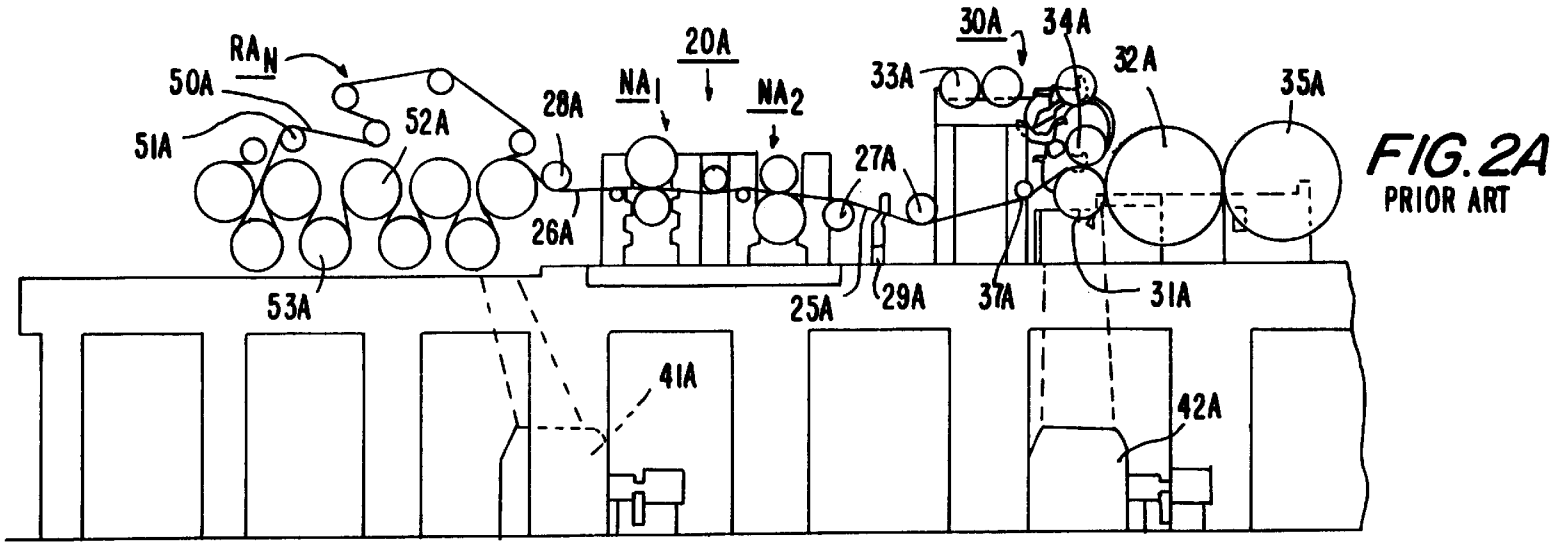
FIG. 2A PRIOR ART
FIG. 2A is a schematic illustration of a prior art arrangement of a finishing section in a paper machine, wherein the last group in the dryer section has been arranged as a group with single-wire draw.

FIG. 2A is a schematic illustration of a prior art arrangement for a finishing section in a paper machine, in which the last dryer group $RA_N$ in the dryer section is a dryer group with single-wire draw. The pulper 41A of the last dryer group $RA_N$ is placed in the basement space. From the last dryer group $RA_N$, the paper web is passed as the draw 26A to the soft calender 20A, where it is calendered from both sides in calendering nips $NA_1$, $NA_2$, after which the web is passed to the reel-up 30A, where a machine reel 32A,35A is formed out of the web. In the dryer group $RA_N$ in the dryer section, the drying wire is denoted by reference numeral 50A, the wire guide rolls are denoted by reference numeral 51A, the drying cylinders are denoted by reference numeral 52A, and the vac rolls in the lower row with the reference numeral 53A. The paper web to be dried runs, in the single-wire draw, from the drying cylinders 52A onto the reversing rolls 53A while constantly supported by the drying wire 50A. After this, the run of the web onward is similar to the arrangement shown in FIG. 1A. In the embodiment shown in FIG. 2A, a quality measurement device 29A is arranged between the calender 20A and the reel-up 30A.

Figure 2B:
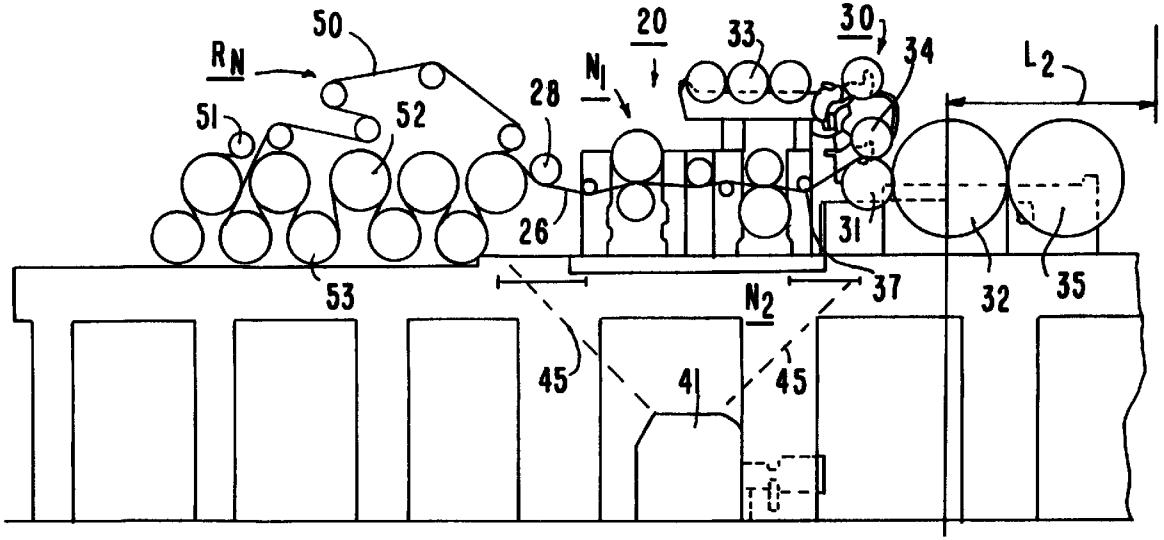
FIG. 2B is a schematic illustration of a finishing section in accordance with the present invention in which, as in FIG. 2A, the last group in the dryer section is a dryer group with single-wire draw.

In the schematic illustration of the embodiment shown in FIG. 2B, the finishing section in the paper machine has been made shorter in accordance with the invention, in which connection the draw 26 from the dryer section to the soft calender 20 has been made slightly shorter and the draw from the soft calender 20 to the reel-up 30 has been eliminated completely as the reel spool storage space 33 in the reel-up 30 is placed above the soft calender 20, whereby considerable economies of space are achieved. The dryer group $R_N$ is a dryer group with single-wire draw, in which the paper web runs on the support of the drying wire 50 from the drying cylinders 52 in the upper row onto the vac rolls 53, which are placed in the lower row. The wire 50 guide rolls are denoted by reference numeral 51. The draw in the final part of the finishing section is substantially similar to that described above in relation to FIG. 1B.

In a transition from the arrangement of FIG. 2A to the arrangement of FIG. 2B, the economies of length $L_2$ that are achieved are, for example, about 6300 mm.

In accordance with the invention, when the finishing section is made shorter, the upper roll of the second nip $N_2$ in the soft calender 20 can be raised from the machine directly upwards through the reel spool storage space 33, which results in an easy and quick replacement of the roll, i.e., the production efficiency of the machine is increased as the time taken by the change of the roll becomes shorter. In the reel spool storage space 33 above the roll, parts, for example latches or equivalent, are opened and permit lifting of the roll through the frame system of the reel spool storage space 33. The frame system of the reel spool storage space 33 is supported on the floor level by means of columns of its own from outside the frame system of the soft calender 20 in order to avoid detrimental effects of oscillations in the soft calender 20. The frame system is supported from both of its ends in the machine direction. By means of the operations described above, easy and quick change of roll is achieved in the soft calender 20, and oscillation-free storage 33 is obtained for the reel spools. Spreading of the effects of formation of dust that may occur in the reel-up 30 to the calender 20 is prevented by, if necessary, constructing an air jet and/or a detachable shield wall (not shown) between the calender 20 and the reel-up 30. A quality measurement beam is constructed between the columns placed between the calender 20 and the reel-up 30 in an integrated way in consideration of attenuation of vibrations. For the reel-up 30 and for the calender 20, just one pulper 41 is needed, which is installed so that the web can be passed from the dryer section $R_N$, from the calender 20 and from the reel-up 30 into the pulper 41. Chutes 45 of the pulper 41 are designed sufficiently long and, if necessary, the pulper 41 is mounted sufficiently far down below in order to provide an inclination downwards. The frame of the reeling equipment 30 is separate from the frames of the reel spool storage space 33 and the calender 20, in which case vibrations and resonance of different components are avoided.

Figure 3:
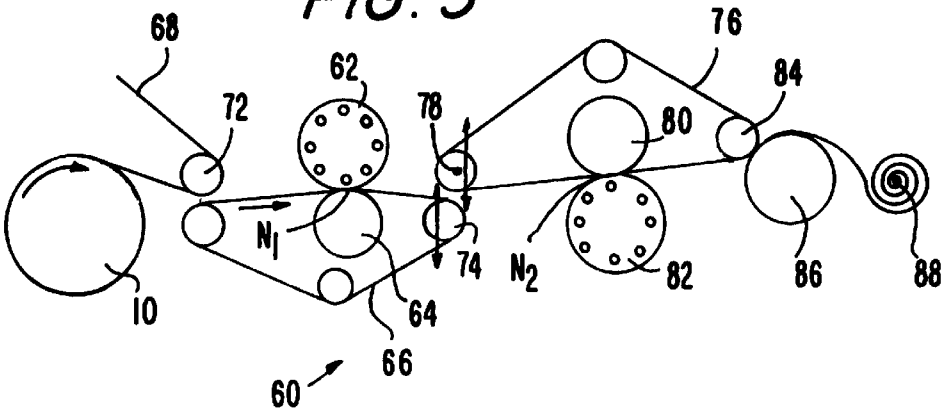
FIG. 3 is a schematic illustration of another embodiment of a calender for a finishing section in accordance with the invention.

Referring now to FIG. 3, this embodiment permits a ropeless threading because there are no long unsupported draws of the web. The calender 60 is a belt calender such as described in U.S. Pat. No. 5,482,872 mentioned above, and includes a first nip $N_1$ defined by a thermo-roll 62 in the upper position and a press member 64 in the lower position, press member 64 being either a roll or a glide shoe. A calendering belt 66 runs over the press member 64 which is situated in a loop thereof. Belt 66 is either pervious or impervious and receives the web from a felt or belt 68 carrying the web over the last drying cylinder 70 in the dryer section and in the vicinity of a guide roll 72 for felt 68. As such, the web is carried on the belt 66 through the nip $N_1$ and pressed in the nip between roll 62 and press member 64. Roll 62 can be arranged to glaze the surface of the web. Belt 66 also runs over guide roll 74 and the web is transferred from belt 66 to calendering belt 76 in a transfer zone defined between guide roll 74 and guide roll 78 in a loop of belt 76, guide rolls 74,78 being situated opposite one another. The position of roll 78 is adjustable as indicated by the arrow to facilitate transfer of the web from belt 66 to belt 76. In the alternative, the position of roll 74 may be adjustable or the position of both rolls 74,78 may be adjustable. Transfer of the web from belt 66 to belt 76 may be carried out in a manner known in the art, i.e., by moistening one or both belts 66,76 or the web before contact between the belts 66,76, or if the belt 66,76 is porous, by means of positive and negative pressure.

In addition to guide roll 78, belt 76 runs over the press member 80 situated in a loop thereof and which may be a roll or a glide shoe. Press member 80 forms a second calendering nip $N_2$ with thermo-roll 82 in which the web is pressed as it runs on belt 76. Belt 76 is either pervious or impervious and the web is carried on the belt 76 through the nip $N_2$ and pressed in the nip between roll 82 and press member 80. Roll 82 can be arranged to glaze the surface of the web. Belt 76 also runs over guide roll 84 into direct contact with reeling cylinder 86 where the web is reeled to form a machine roll, machine reel or roll spool 88. As in the embodiments shown in FIGS. 1B and 2B, the calender 60 is situated at least partly underneath the reel storage space 33 of the reel-up 30, e.g., the second calendering nip $N_2$ would be situated entirely below the reel storage space 33 (not shown in FIG. 3).

Figure 4:
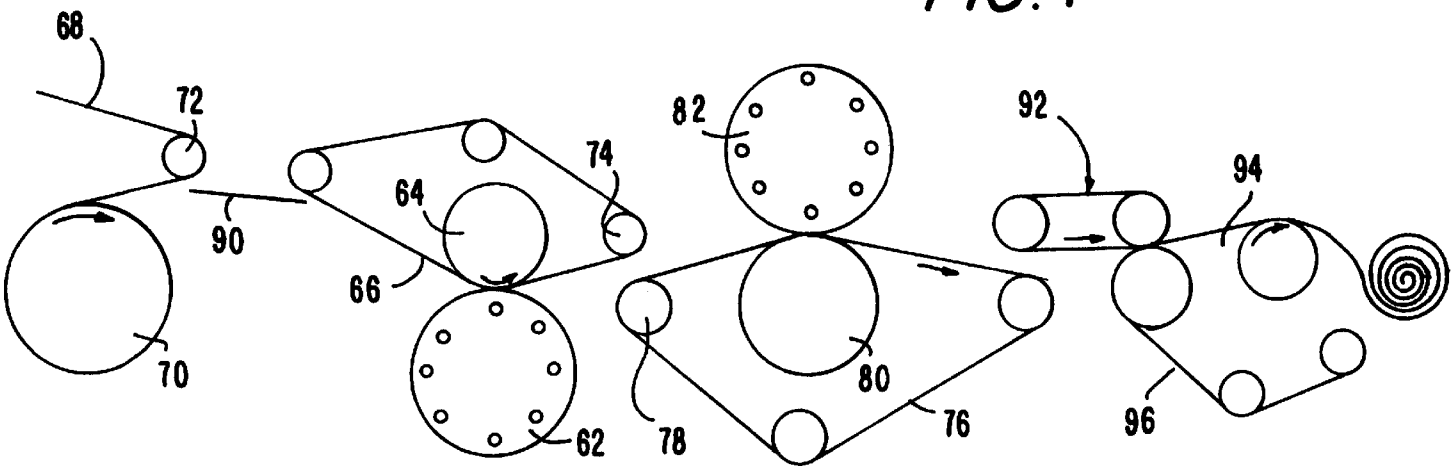
FIG. 4 is a schematic illustration of still another embodiment of a calender for a finishing section in accordance with the invention.

The embodiment shown in FIG. 4 differs from that shown in FIG. 3 in several respects. First, the transfer of the web from felt 68 is not directly to the first calendering belt 66 as shown in FIG. 3, but rather, the web is passed over a guide plate or blow plate 90 arranged to provide a full-width transfer of the web, i.e., it extends over the full width of the web. Blow plate 90 may be movable and comprise cutting devices both at the initial end and final end. Movability of the blow plate 90 facilitates detachment of a full-width web from the guide roll 72 whereby the web may be directed, e.g., downward into a pulper. Second, the relative position of the rolls 62,82, press members 64,80 and thus calendering belts 66,76 in each calendering nip $N_1$ and $N_2$ is reversed vis-a-vis the arrangement shown in FIG. 3. Third, a belt transfer device 92 is present for transferring the web from the calendering belt 76 to a belt 94 of a belt reel-up 96. Belt transfer device 92 may be a full-width threading device including suction/blow zones of the type manufactured by Fibron Machinery Corp. In other respects, the finishing section is similar to the embodiment shown in FIG. 3 and may incorporate the features thereof (as well as the features of the embodiments shown in FIGS. 1B and 2B).

With respect to the embodiments in FIGS. 3 and 4, wherein a belt calender is used, ropeless threading can be arranged quite simply so that the web is passed from the last drying cylinder 70 in the dryer section onto the belt 66 in the belt calender 60 indirectly by means of a blow plate 90 or directly thereon. The web is passed through the calendering nips and further onto the belt in the belt reel-up 96 (FIG. 4).

In FIGS. 1B, 2B, 3 and 4, some preferred exemplifying embodiments are illustrated of the web finishing section in accordance with the invention in a paper machine. This is, of course, not supposed to confine the invention to such finishing sections alone, but variations of many other, different types are also possible. For example, instead of the cylinder dryer groups illustrated in the figures, the dryer groups can be constructed, for example, by employing a dryer concept based on the heat pipe effect (CONDEBELT), by means of airborne web dryers, dryers based on infrared radiation, etc. Of course, the reel-up and the calender shown in the figures can also differ from the embodiments illustrated in the figures. For example, instead of a soft calender it is possible to use calenders of different types, a machine stack, a supercalender, etc.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A web finishing section in a paper machine, comprising a dryer section having at least one dryer group for drying the web, a reel-up arranged after said dryer section for reeling the web, said reel-up including means defining a reel spool storage space in which empty reel spools are stored and a reel cylinder over which the web is passed to be reeled onto a reel spool, and a calender arranged after said dryer section and at least partly underneath said reel spool storage space such that said reel-up is situated substantially directly after said calender, said calender including at least a first calendering nip defined by two rolls and at least a first calendering belt for carrying the web through said first calendering nip such that the web is calendered in said first calendering nip.

2. The finishing section of claim 1, wherein said calender is arranged such that said first calendering belt receives the web directly from a belt in said dryer section.

3. The finishing section of claim 1, wherein said calender is arranged such that the web is passed into said reel-up directly from said first calendering belt.

4. The finishing section of claim 1, further comprising a second calendering nip defined by two rolls and a second calendering belt for carrying the web through said second calendering nip, the web being transferred between said first and second calendering belts at a location between said first and second calendering nips.

5. The finishing section of claim 4, further comprising guide rolls arranged in a loop of each of said first and second calendering belts, one of said guide rolls in said loop of each of said first and second calendering belts being arranged opposite one another such that the web is transferred between said first and second calendering belts about said opposite guide rolls, at least one of said opposite guide rolls being adjustable.

6. The finishing section of claim 4, wherein one of said first and second calendering nips is arranged entirely underneath said reel storage space.

7. The finishing section of claim 1, wherein said first calendering nip is defined by a press member situated in a loop of said first calendering belt and a roll situated opposite said press member.

8. The finishing section of claim 1, further comprising a blow plate arranged in a space between said dryer section and said calender, the web being transferred from said dryer section to said first calendering belt through said space.

9. The finishing section of claim 1, further comprising a belt transfer device for transferring the web from said first calendering belt to said reel-up.

10. The finishing section of claim 1, further comprising only a single guide member for supporting and/or spreading the web in a run between said first calendering nip and said reel cylinder.

11. The finishing section of claim 1, wherein said calender is arranged substantially directly after a last one of said at least one dryer group in the dryer section in a running direction of the web.

12. The finishing section of claim 1, further comprising a single pulper for receiving pulp from said dryer section, said calender and said reel-up.

13. A method for finishing a web in a finishing section in a paper machine, comprising the steps of:

drying the web by passing the web through a dryer section having at least one dryer group, then calendering the dried web after the dryer section in a calender including a first calendering belt by transferring the web to a first calendering belt and carrying the web on the first calendering belt through at least a first calendering nip defined by two rolls, then reeling the calendered web in a reel-up by passing the web over a reel cylinder onto a reel spool, and storing empty reel spools for use in the reel-up in a reel spool storage space defined at least partially above the calender.

14. The method of claim 13, further comprising the step of:

passing the web directly from a belt in the dryer section to the first calendering belt.

15. The method of claim 13, further comprising the step of:

passing the web directly from the first calendering belt to the reel-up.

16. The method of claim 13, further comprising the steps of:

transferring the web from the first calendering belt to a second calendering belt, directing the second calendering belt with the web thereon into and through a second calendering nip defined by two rolls, the second calendering nip being arranged below the reel storage space, and transferring the web from the second calendering belt to the reel-up.

17. The method of claim 16, further comprising the steps of:

arranging guide rolls arranged in a loop of each of the first and second calendering belts, one of the guide rolls in the loop of each of the belts being arranged opposite one another, transferring the web from the first calendering belt to the second calendering belt about the opposite guide rolls, and adjusting the position of at least one of the opposite guide rolls.

18. The method of claim 13, further comprising the step of:

arranging the first calendering nip entirely underneath the reel storage space.

19. The method of claim 13, further comprising the steps of:

arranging a blow plate in a space between the dryer section and the calender, and transferring the web from the dryer section to the first calendering belt through the space and over the blow plate.

20. The method of claim 19, further comprising the step of:

moving the blow plate to facilitate detachment of the web from the belt in the dryer section.

21. The method of claim 13, further comprising the step of:

transferring the web from the first calendering belt to the reel-up by means of a belt transfer device.

22. The method of claim 13, further comprising the step of:

supporting the web in a run between the calendering nip and the reel cylinder by means of only a single guide roll.

23. The method of claim 13, further comprising the step of:

arranging the calender substantially directly after a last one of the at least one dryer group in the dryer section in a running direction of the web.

* * * * *